US012521841B2

(12) United States Patent
Golubovsky et al.

(10) Patent No.: US 12,521,841 B2
(45) Date of Patent: Jan. 13, 2026

(54) PAD CARRIER ASSEMBLY FOR HORIZONTAL PRE-CLEAN MODULE

(71) Applicant: Applied Materials, Inc., Santa Clara, CA (US)

(72) Inventors: Edward Golubovsky, San Jose, CA (US); Clinton Sakata, San Jose, CA (US); Jagan Rangarajan, San Jose, CA (US); Ekaterina A. Mikhaylichenko, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 457 days.

(21) Appl. No.: 18/094,225

(22) Filed: Jan. 6, 2023

(65) Prior Publication Data

US 2023/0264319 A1 Aug. 24, 2023

Related U.S. Application Data

(60) Provisional application No. 63/312,371, filed on Feb. 21, 2022.

(51) Int. Cl.
*B24B 41/06* (2012.01)
*B24B 37/20* (2012.01)

(52) U.S. Cl.
CPC ..... *B24B 41/061* (2013.01); *B24B 37/20* (2013.01)

(58) Field of Classification Search
CPC ..... B24B 7/228; B24B 45/006; B24B 53/017; B24B 41/047; B24B 41/053; B24B 37/12; B24B 37/20; B24B 37/10; B24B 37/105
(Continued)

(56) References Cited

U.S. PATENT DOCUMENTS 5,567,503 A 10/1996 Sexton et al.
7,137,875 B2 * 11/2006 Jeansson ..... B24B 7/186 451/350
(Continued)

FOREIGN PATENT DOCUMENTS

CN 103707193 A 4/2014
CN 107257721 A 10/2017
(Continued)

OTHER PUBLICATIONS

Chinese Office Action issued to Application No. 202320204085.X on Mar. 23, 2023.
(Continued)

*Primary Examiner* — Robert F Neibaur
(74) *Attorney, Agent, or Firm* — Patterson & Sheridan LLP.

(57) ABSTRACT

A pad carrier assembly that includes a coupling base and a pad carrier coupled to the coupling base, the coupling base and the pad carrier are configured to support a buffing pad by a mechanical clamping mechanism. Embodiments of the present disclosure will provide a method of supporting a buffing pad in a horizontal pre-clean module. The method includes mechanically clamping or retaining a buffing pad on a peripheral edge of the buffing pad, wherein the coupling base and the pad carrier are coupled and disposed in a horizontal pre-clean module, and supporting the buffing pad and preventing the buffing pad from sagging, by use of one or more pad retaining features.

20 Claims, 12 Drawing Sheets

(58) Field of Classification Search
USPC ..... 451/41, 287, 290, 342, 363, 494, 508
See application file for complete search history.

(56) References Cited

U.S. PATENT DOCUMENTS

| | | | | |
|---|---|---|---|---|
| 8,029,340 | B2 * | 10/2011 | Henning | B24B 45/006 451/508 |
| 2001/0024936 | A1 | 9/2001 | Ishikawa et al. | |
| 2001/0041650 | A1 | 11/2001 | Senga et al. | |
| 2007/0238399 | A1 | 10/2007 | Tolles et al. | |
| 2008/0125022 | A1 | 5/2008 | Huang et al. | |
| 2013/0324012 | A1 | 12/2013 | Fukushima et al. | |
| 2014/0179204 | A1 * | 6/2014 | Shinozaki | B24B 53/017 451/443 |
| 2018/0001441 | A1 | 1/2018 | Ang et al. | |
| 2018/0345452 | A1 | 12/2018 | Aizawa et al. | |
| 2019/0118338 | A1 | 4/2019 | Yamaguchi et al. | |
| 2019/0240798 | A1 * | 8/2019 | Valentini | B24B 23/02 |
| 2021/0114163 | A1 | 4/2021 | Kang et al. | |
| 2022/0199396 | A1 | 6/2022 | Golubovsky et al. | |

FOREIGN PATENT DOCUMENTS

| | | | |
|---|---|---|---|
| CN | 114643531 | A | 6/2022 |
| CN | 221911389 | U | 10/2024 |
| EP | 561610 | A1 | 9/1993 |
| EP | 2422930 | A2 | 2/2012 |
| JP | 6329813 | B2 | 5/2018 |

OTHER PUBLICATIONS

International Search Report/ Written Opinion issued to PCT/US2023/010329 on May 2, 2023.
Chinese Office Action dtd May 21, 25 for CN 202310109265.4.
Korean Office Action in application 2024-7031465, dtd Apr. 29, 2025.
CN Office Action dated May 22, 2024 for Application No. 202320204085.X.
U.S. Appl. No. 17/510,111, filed Oct. 25, 2021.
U.S. Appl. No. 29/735,362, filed May 20, 2020.
International Search Report and Written Opinion dated Feb. 17, 2022 for Application No. PCT/US2021/056678.

* cited by examiner

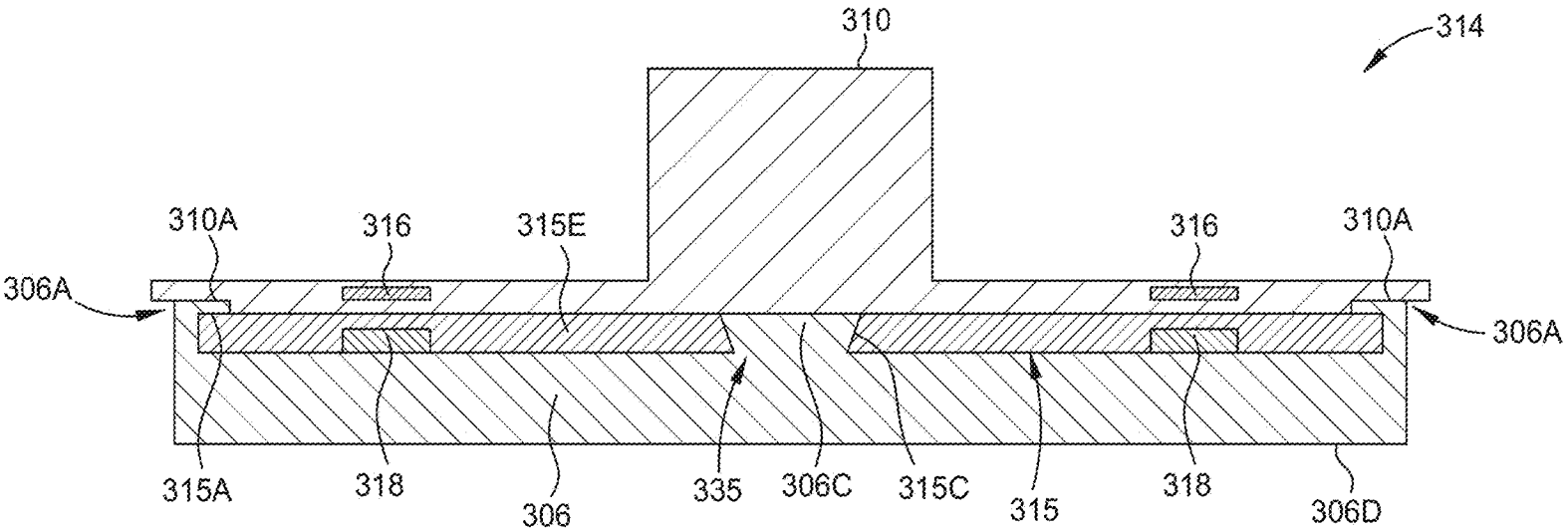
FIG. 3A
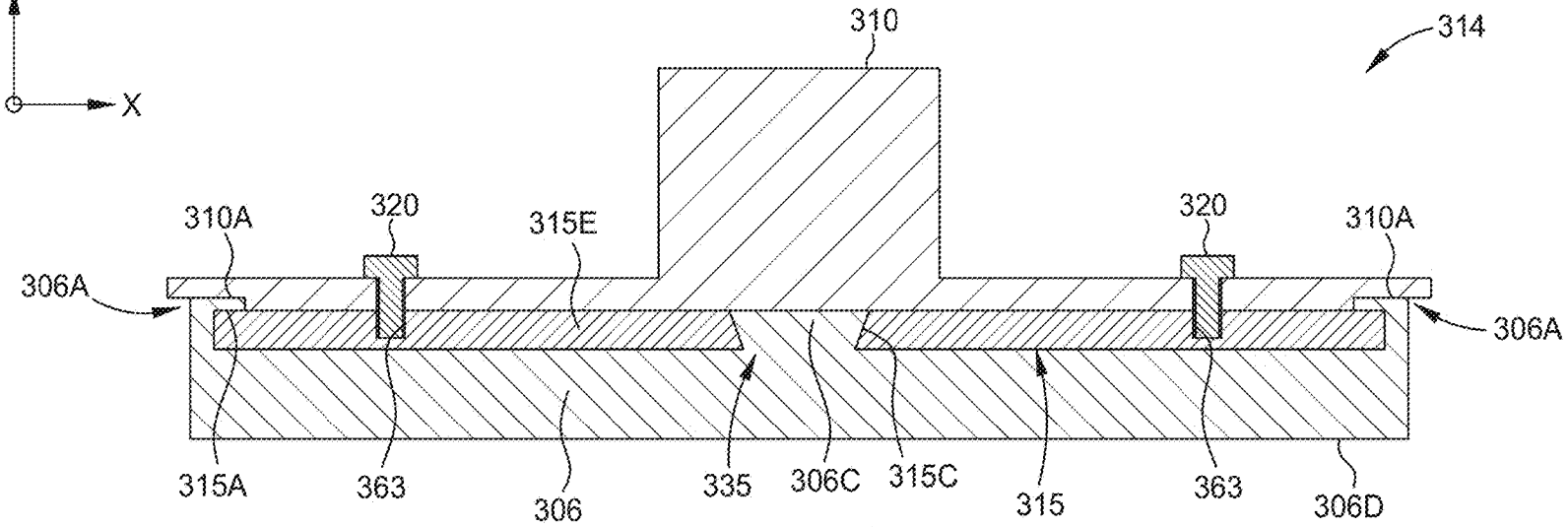
FIG. 3B
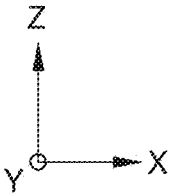

PAD CARRIER ASSEMBLY FOR HORIZONTAL PRE-CLEAN MODULE

CROSS-REFERENCE TO RELATED APPLICATIONS

This application claims benefit of U.S. provisional patent application Ser. No. 63/312,371, filed Feb. 21, 2022, which is herein incorporated by reference.

BACKGROUND

Field

Embodiments described herein generally relate to equipment used in the manufacturing of electronic devices, and more particularly, to a horizontal pre-clean (HPC) module which may be used to clean the surface of a substrate in a semiconductor device manufacturing process.

Description of the Related Art

Chemical mechanical polishing (CMP) is commonly used in the manufacturing of high-density integrated circuits to planarize or polish a layer of material deposited on a substrate. In a horizontal pre-clean (HPC) module used in a CMP process, a rotating buffing pad is pressed against a material layer on a surface of the substrate, and material is removed across the material layer through a combination of chemical and mechanical activity provided by a polishing fluid and relative motion of the buffing bad and the substrate. As compared with a conventional buffing pad formed of material, such as poromeric material or filled or unfilled polymer material, a buffing pad formed of polyvinyl alcohol (PVA) material provides high shear force for chemical and mechanical polishing due to mechanical strength and abrasion resistance. PVA material is water absorbent, soft, and elastic, in addition to being inherently thicker and larger than the conventional material. Furthermore, a larger buffing pad improves performance and reduces buffing time in chemical mechanical cleaning. However, a buffing pad formed of PVA material may sag when supported by a pad carrier due to the inherently thicker and larger size.

Therefore, there is a need for systems and methods for supporting a large and thick water absorbent buffing pad while preventing the buffing pad from sagging.

SUMMARY

Embodiments of the present disclosure also provide a pad carrier assembly for use in a horizontal pre-clean module. A pad carrier assembly includes a coupling base, and a pad carrier coupled to the coupling base. The coupling base and the pad carrier are configured to support a buffing pad by a mechanical clamping mechanism.

Embodiments of the present disclosure further provide a method of supporting a buffing pad in a horizontal pre-clean module. The method includes mechanically clamping a buffing pad on a peripheral edge of the buffing pad by a lip portion of a coupling base and a tapered portion of a pad carrier, wherein the coupling base and the pad carrier are coupled and disposed in a horizontal pre-clean module, and supporting the buffing pad and preventing the buffing pad from sagging, by use of one or more pad retaining features.

Embodiments of the present disclosure may further provide a pad carrier for use in a polishing or cleaning process comprising a pad carrier assembly that is configured to be coupled to a first end of a pad carrier positioning arm, and a support plate that comprises a support body. The pad carrier assembly comprises a clamp plate that comprises a clamp body that comprises one or more ferromagnetic or paramagnetic material containing elements disposed within the clamp body, and a first retaining surface disposed on a first side of the clamp body. The support body of the support plate comprises a second retaining surface disposed on a first side of the support body, and a plurality of support plate retaining features. Each support plate retaining feature is configured to receive a pad retaining feature formed in a buffing pad when a lip portion of the buffing pad is positioned between first and second retaining surfaces. The pad carrier may further comprise a coupling base that comprises a coupling body that comprises one or more ferromagnetic or paramagnetic material containing elements disposed within the body, wherein each of the one or more ferromagnetic or paramagnetic material containing elements within the coupling body of the coupling base is configured to oppose each of the one or more ferromagnetic or paramagnetic material containing elements within the support body of the support plate when the coupling base is positioned over a second side of the support body of the support plate, and the second side of the support body of the support plate is opposite to the first side. The one or more ferromagnetic or paramagnetic material containing elements in the coupling base or the clamp plate may comprise a ferromagnetic or paramagnetic containing element that is formed in a toroidal shape.

Embodiments of the present disclosure may further provide a pad carrier for use in a polishing or cleaning process, comprising a pad carrier assembly that is configured to be coupled to a first end of a pad carrier positioning arm. The pad carrier assembly comprising a coupling base that comprises a coupling body, and a support plate that comprises a support body. The coupling body of the coupling base comprises an array of magnets, and a first retaining surface disposed on a first side of the coupling body. The support body of the support plate comprises an array of magnets disposed therein, a second retaining surface disposed on a first side of the support body, and a plurality of support plate retaining features. Each support plate retaining feature is configured to receive a pad retaining feature formed in a buffing pad when a lip portion of the buffing pad is positioned between first and second retaining surfaces.

Embodiments of the present disclosure may further provide a pad carrier for use in a polishing or cleaning process, comprising a pad carrier assembly that is configured to be coupled to a first end of a pad carrier positioning arm. The pad carrier assembly comprising a clamp plate that comprises a clamp body, and a support plate that comprises a support body. The clamp body of the clamp plate comprises one or more magnets disposed within the clamp body, and a first retaining surface disposed on a first side of the clamp body. The support body of the support plate comprises a second retaining surface disposed on a first side of the support body, and a plurality of support plate retaining features. Each support plate retaining feature is configured to receive a pad retaining feature formed in a buffing pad when a lip portion of the buffing pad is positioned between first and second retaining surfaces.

Embodiments of the present disclosure may further provide a pad carrier for use in a polishing or cleaning process, comprising a pad carrier assembly that is configured to be coupled to a first end of a pad carrier positioning arm. The pad carrier assembly comprising a coupling base that comprises a first retaining surface disposed on a first side of the coupling body, and a support plate that comprises a support body that comprises a second retaining surface disposed on a first side of the support body. The support plate having a plurality of support plate retaining features where each support plate retaining feature is configured to receive a pad retaining feature formed in a buffing pad when a lip portion of the buffing pad is positioned between first and second retaining surfaces.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 3A-3D are each side sectional views of a coupling base and a pad carrier, according to one or more embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments described herein generally relate to equipment used in the manufacturing of electronic devices, and more particularly, to a horizontal pre-clean (HPC) module which may be used to clean the surface of a substrate during a portion of a semiconductor device manufacturing processing sequence.

During a cleaning process, a buffing pad formed of a polyvinyl alcohol (PVA) material provides a high shear force across the surface of a substrate that is to be cleaned, which is used to remove residue from the surface of the substrate due to the material's mechanical strength and abrasion resistance. However, PVA material is water absorbent, soft, and elastic, in addition to being inherently thicker and larger than the conventional pad materials, and thus a buffing pad formed of PVA material may sag when supported by a pad carrier.

In the embodiments described herein, pad carriers support a large and thick water absorbent buffing pad while preventing the buffing pad from sagging by a mechanical clamping mechanism, use of interlocking features, magnetic clamping mechanism and/or a suction clamping mechanism during the chemical mechanical cleaning process.

Figure 1A:
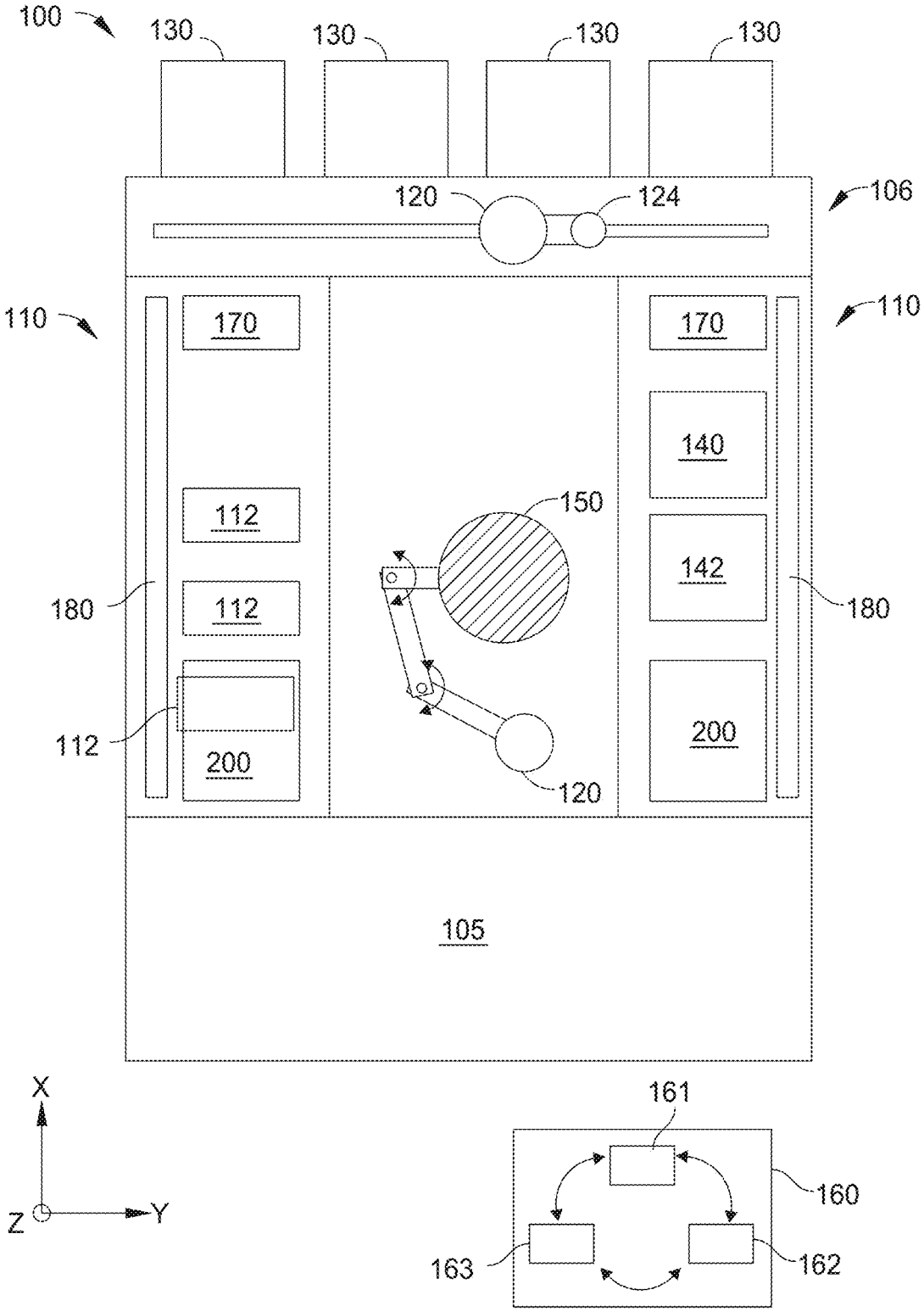
FIG. 1A is a schematic plan view of an exemplary chemical mechanical polishing (CMP) processing system, which uses a horizontal pre-clean (HPC) module described herein, according to one or more embodiments.
Figure 1B:
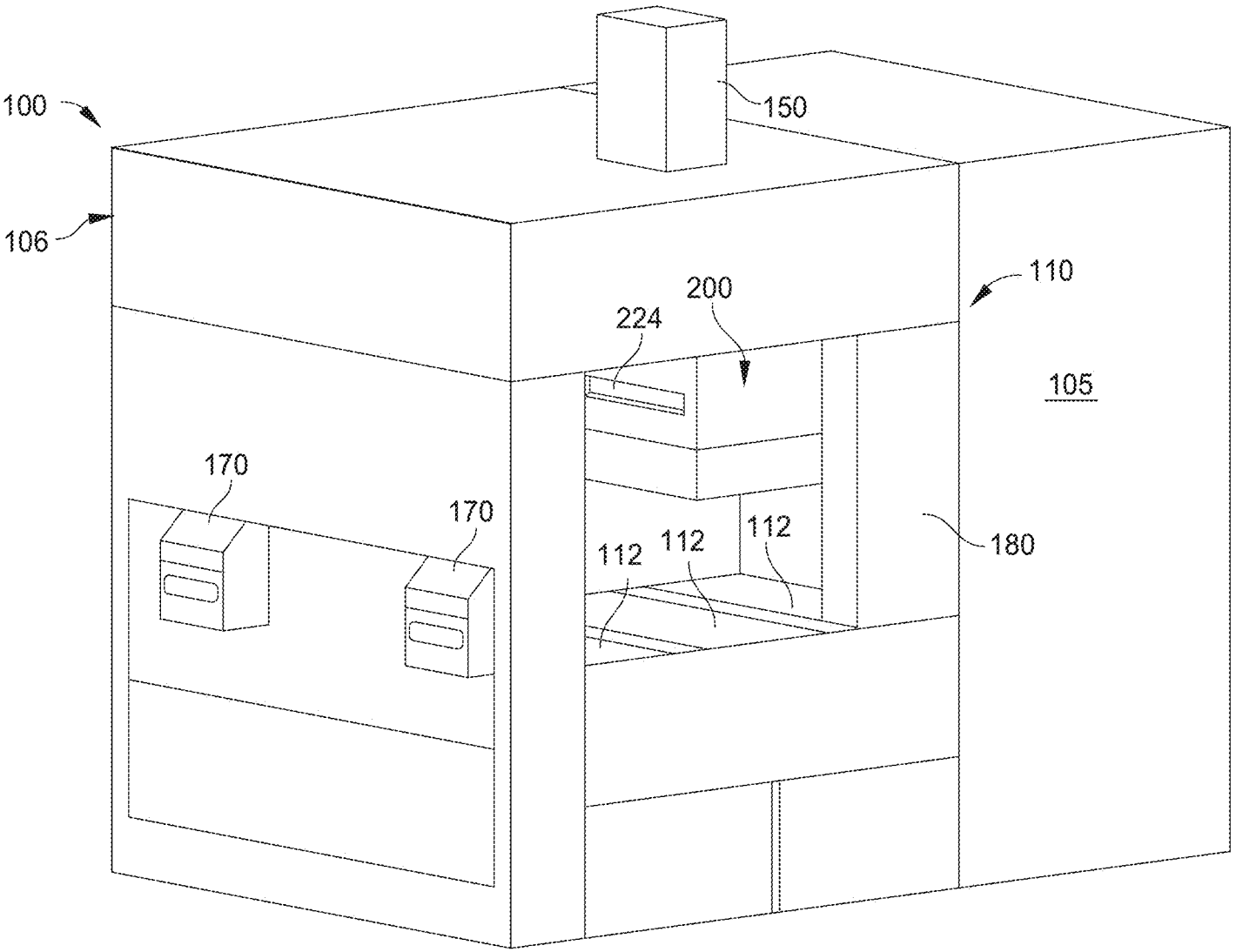
FIG. 1B is a top isometric view of an exemplary CMP processing system, which may correspond to the schematic view shown in FIG. 1A, according to one or more embodiments.
Figure 1C:
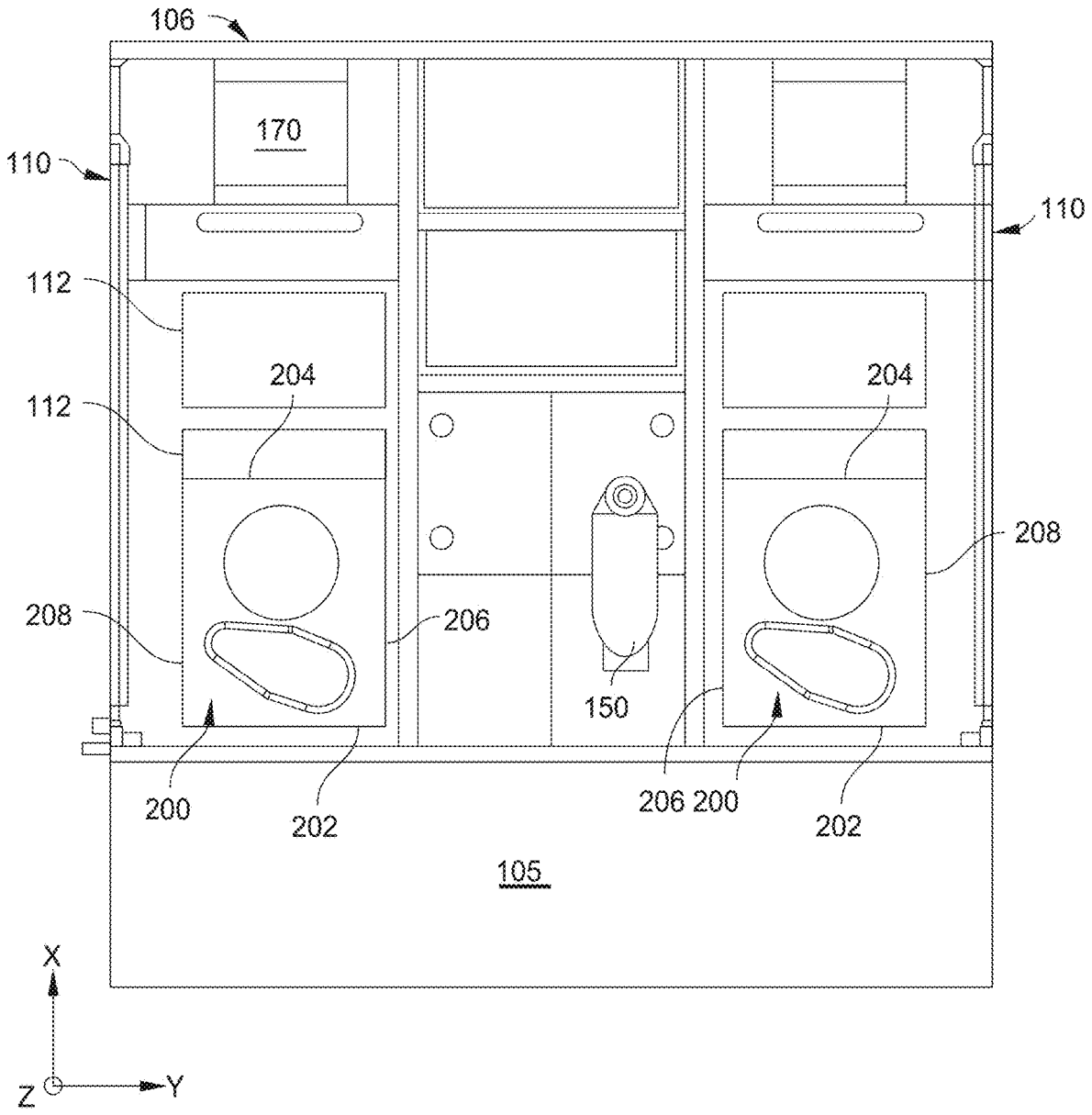
FIG. 1C is a top elevation view of the CMP processing system of FIG. 1B, which may correspond to the schematic view shown in FIG. 1A, according to one or more embodiments.

FIG. 1A is a schematic plan view of an exemplary chemical mechanical polishing (CMP) processing system 100, which uses a horizontal pre-clean (HPC) module described herein, according to one or more embodiments. FIG. 1B is a top isometric view of an exemplary CMP processing system 100 which may correspond to the schematic view shown in FIG. 1A, according to one or more embodiments. FIG. 1C is a top elevation view of the CMP processing system 100 of FIG. 1B which may correspond to the schematic view shown in FIG. 1A, according to one or more embodiments. In FIGS. 1B and 1C, certain parts of the housing and certain other internal and external components are omitted to more clearly show the HPC module within the CMP processing system 100. Here, the CMP processing system 100 includes a first portion 105 and a second portion 106 coupled to the first portion 105 and integrated therewith. The first portion 105 is a substrate polishing portion featuring a plurality of polishing stations (not shown).

The second portion 106 includes one or more post-CMP cleaning systems 110, a plurality of system loading stations 130, one or more substrate handlers, e.g., a first robot 124 and a second robot 150, one or more metrology stations 140, one or more location specific polishing (LSP) modules 142, one or more HPC modules 200, and one or more drying units 170. The HPC module 200 is configured to process a substrate 120 disposed in a substantially horizontal orientation (i.e., in the x-y plane). In some embodiments, the second portion 106 optionally includes one or more vertical cleaning modules 112 configured to process substrates 120 disposed in substantially vertical orientations (i.e., in the z-y plane).

Each LSP module 142 is typically configured to polish only a portion of a substrate surface using a polishing member (not shown) that has a surface area that is less than the surface area of a to-be polished substrate 120. LSP modules 142 are often used after the substrate 120 has been polished with a polishing module to touch up, e.g., remove additional material, from a relatively small portion of the substrate.

The metrology station 140 is used to measure the thickness of a material layer disposed on the substrate 120 before and/or after polishing, to inspect the substrate 120 after polishing to determine if a material layer has been cleared from the field surface thereof, and/or to inspect the substrate surface for defects before and/or after polishing. In those embodiments, the substrate 120 may be returned to the LSP module for further polishing and/or directed to a different substrate processing module or station, such as a polishing module within the first portion 105 or to an LSP module 142 based on the measurement or surface inspection results obtained using the metrology station 140. As shown in FIG. 1A, a metrology station 140 and an LSP module 142 are located in a region of the second portion 106 that is above (in the Z-direction) portions of one of the post-CMP cleaning systems 110.

The first robot 124 is positioned to transfer substrates 120 to and from the plurality of system loading stations 130, e.g., between the plurality of system loading stations 130 and the second robot 150 and/or between the post-CMP cleaning system 110 and the plurality of system loading stations 130. In some embodiments, the first robot 124 is positioned to transfer the substrate 120 between any of the system loading stations 130 and a processing system positioned proximate thereto. For example, in some embodiments, the first robot 124 may be used to transfer the substrate 120 between one of the system loading stations 130 and the metrology station 140.

The second robot 150 is used to transfer the substrate 120 between the first portion 105 and the second portion 106. For example, here the second robot 150 is positioned to transfer a to-be-polished substrate 120 received from the first robot 124 to the first portion 105 for polishing therein. The second robot 150 is then used to transfer the polished substrate 120 from the first portion 105, e.g., from a transfer station (not shown) within the first portion 105, to one of the HPC modules 200 and/or between different stations and modules located within the second portion 106. Alternatively, the second robot 150 transfers the substrate 120 from the transfer station within the first portion 105 to one of the LSP modules 142 or the metrology station 140. The second robot 150 may also transfer the substrate 120 from either of the LSP modules 142 or the metrology station 140 to the first portion 105 for further polishing therein.

The CMP processing system 100 in FIG. 1A features two post-CMP cleaning systems 110 disposed on either side of the second robot 150. In FIG. 1A at least some modules of one of the post-CMP cleaning systems 110, e.g., one or more vertical cleaning modules 112, are located below (in the Z-direction) the metrology station 140 and the LSP module 142 and are thus not shown. The metrology station 140 and the LSP module 142 are not shown in FIG. 1C. In some other embodiments, the CMP processing system 100 features only one post-CMP cleaning system 110. Here, each of the post-CMP cleaning systems 110 includes an HPC module 200, one or more vertical cleaning modules 112, e.g., brush or spray boxes, a drying unit 170, and a substrate handler 180 for transferring substrates 120 therebetween. Here, each HPC module 200 is disposed within the second portion 106 in a location proximate to the first portion 105.

Typically, the HPC module 200 receives a polished substrate 120 from the second robot 150 through a first opening (not shown) formed in a side panel of the HPC module 200, e.g., though a door or a slit valve disposed in the side panel. The substrate 120 is received in a horizontal orientation by the HPC module 200 for positioning on a horizontally disposed substrate support surface therein. The HPC module 200 then performs a pre-clean process, such as a buffing process, on the substrate 120 before the substrate 120 is transferred therefrom using a substrate handler 180.

The substrate 120 is transferred from the HPC module 200 through a second opening, here an opening 224 (FIG. 1B), which is typically a horizontal slot disposed though a second side panel of the HPC module 200 closeable with a door, e.g., a slit valve. Thus, the substrate 120 is still in a horizontal orientation as it is transferred from the HPC module 200. After the substrate 120 is transferred from the HPC module 200, the substrate handler 180 swings the substrate 120 to a vertical position for further processing in the vertical cleaning modules 112 of the post-CMP cleaning system 110.

In this example, the HPC module 200 has a first end 202 facing the first portion 105 of the CMP processing system 100, a second end 204 facing opposite the first end 202, a first side 206 facing the second robot 150, and a second side 208 facing opposite the first side 206. The first and second sides 206, 208 extend orthogonally between the first and second ends 202, 204.

The plurality of vertical cleaning modules 112 are located within the second portion 106. The one or more vertical cleaning modules 112 are any one or combination of contact and non-contact cleaning systems for removing polishing byproducts from the surfaces of a substrate, e.g., spray boxes and/or brush boxes.

The drying unit 170 is used to dry the substrate 120 after the substrate has been processed by the vertical cleaning modules 112 and before the substrate 120 is transferred to a system loading station 130 by the first robot 124. Here, the drying unit 170 is a horizontal drying unit, such that the drying unit 170 is configured to receive a substrate 120 through an opening (not shown) while the substrate 120 is disposed in a horizontal orientation.

Herein, substrates 120 are moved between the HPC module 200 and the vertical cleaning modules 112, between individual ones of the vertical cleaning modules 112, and between the vertical cleaning modules 112 and the drying unit 170 using the substrate handler 180.

In embodiments herein, operation of the CMP processing system 100, including the substrate handler 180, is directed by a system controller 160. The system controller 160 includes a programmable central processing unit (CPU) 161 which is operable with a memory 162 (e.g., non-volatile memory) and support circuits 163. The support circuits 163 are conventionally coupled to the CPU 161 and comprise cache, clock circuits, input/output subsystems, power supplies, and the like, and combinations thereof coupled to the various components of the CMP processing system 100, to facilitate control thereof. The CPU 161 is one of any form of general purpose computer processor used in an industrial setting, such as a programmable logic controller (PLC), for controlling various components and sub-processors of the processing system. The memory 162, coupled to the CPU 161, is non-transitory and is typically one or more of readily available memories such as random access memory (RAM), read only memory (ROM), floppy disk drive, hard disk, or any other form of digital storage, local or remote.

Typically, the memory 162 is in the form of a non-transitory computer-readable storage media containing instructions (e.g., non-volatile memory), which when executed by the CPU 161, facilitates the operation of the CMP processing system 100. The instructions in the memory 162 are in the form of a program product such as a program that implements the methods of the present disclosure. The program code may conform to any one of a number of different programming languages. In one example, the disclosure may be implemented as a program product stored on computer-readable storage media for use with a computer system. The program(s) of the program product define functions of the embodiments (including the methods described herein).

Illustrative non-transitory computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory devices, e.g., solid state drives (SSD)) on which information may be permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure. In some embodiments, the methods set forth herein, or portions thereof, are performed by one or more application specific integrated circuits (ASICs), field-programmable gate arrays (FPGAs), or other types of hardware implementations. In some other embodiments, the substrate processing and/or handling methods set forth herein are performed by a combination of software routines, ASIC(s), FPGAs and, or, other types of hardware implementations. One or more system controllers 160 may be used with one or any combination of the various modular polishing systems described herein and/or with the individual polishing modules thereof.

Figure 2A:
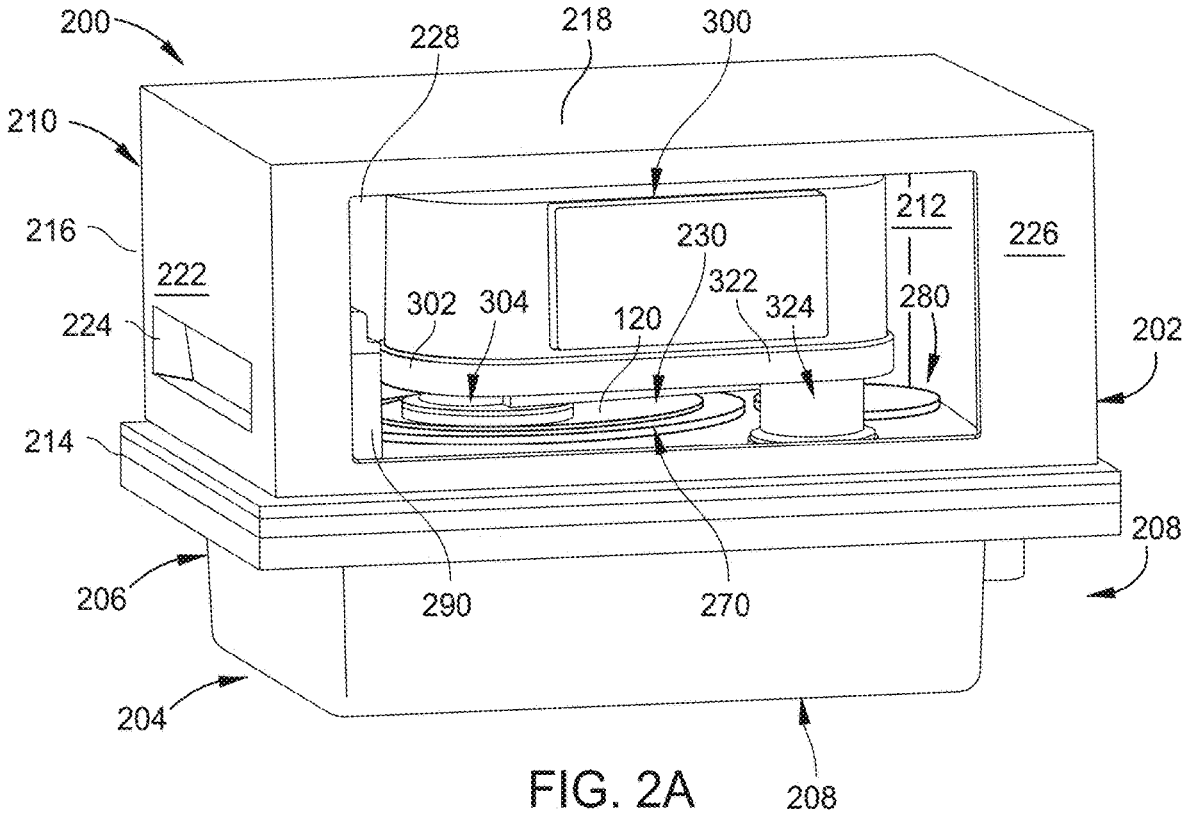
FIG. 2A is a top isometric view of one side of an exemplary HPC module according to one or more embodiments.

FIG. 2A is a top isometric view of the second side 208 of an exemplary HPC module 200 which may be used in the CMP processing system 100 described herein. In FIG. 2A, a service access panel is omitted to more clearly show the internal components of the HPC module 200.

Generally, the HPC module 200 includes a chamber 210, a basin 214, and a lid 216, formed of a plurality of side panels which collectively define a processing area 212.

A first side panel 218 is formed on the first side 206 of the HPC module 200 facing the second robot 150, and includes a first substrate handler access door (not shown) used for positioning a substrate 120 on a rotatable vacuum table 230 with the second robot 150. A second side panel 222 is formed on the second end 204 of the HPC module 200 facing away from the first portion 105. The second side panel 222 includes a second substrate handler access door opening 224 used for removing the substrate 120 from the rotatable vacuum table 230 with the substrate handler 180. A third side panel 226 is formed on the second side 208 of the HPC module 200. The third side panel 226 includes a service access panel opening 228. The symmetry of the first substrate handler access door and the service access panel opening 228 formed on opposite side panels of the HPC module 200 beneficially provides a horizontal buffing module that can be installed on either side of the processing system 100 as illustrated in FIG. 1C.

Disposed within the processing area 212, the HPC module 200 further includes the rotatable vacuum table 230 for vacuum chucking a substrate 120, an annular substrate lift mechanism 270 disposed radially outward of the rotatable vacuum table 230, a pad conditioning station 280 disposed proximate the rotatable vacuum table 230, and a pad carrier positioning arm 300 movable between a first position over the rotatable vacuum table 230 and a second position over the pad conditioning station 280. The rotatable vacuum table 230, the annular substrate lift mechanism 270, the pad conditioning station 280, and the pad carrier positioning arm 300 are each independently mounted to the basin 214.

Figure 2B:
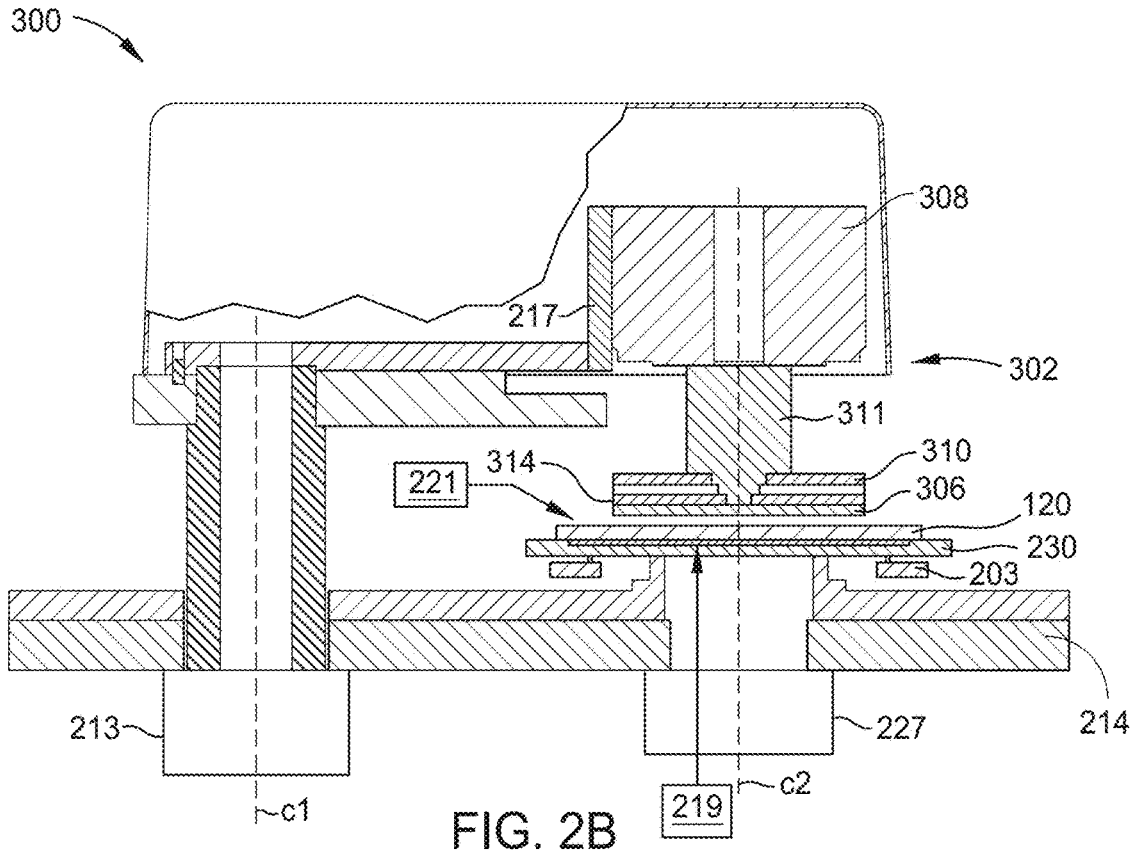
FIG. 2B is a side sectional view of an exemplary pad carrier positioning arm according to one or more embodiments.

FIG. 2B is a side sectional view of an exemplary pad carrier positioning arm 300 which may be used in the HPC module 200 of FIG. 2A. The pad carrier positioning arm 300 is disposed proximate to the rotatable vacuum table 230 and the pad conditioning station 280 (FIG. 2A). A distal end 302 of the pad carrier positioning arm 300 includes a vertically movable pad carrier assembly 304 for supporting a buffing pad 306 at a lower end thereof. The pad carrier assembly 304 includes a head motor 308 for rotating the buffing pad 306 about an axis c2 which is substantially aligned in the direction of gravity. The pad carrier assembly 304 includes a coupling base 310, which is coupled to the head motor 308 via shaft 311 and also couples a pad carrier 314 to the head motor 308. In some embodiments, the pad carrier 314 is sized to support a buffing pad 306 having a diameter of between about 40 mm and 150 mm, such as between about 70 mm and 150 mm, such as about 134 mm which is larger than conventional buffing pads used in similar cleaning modules. In some embodiments, the pad carrier positioning arm 300 of the present disclosure supports a larger buffing pad 306 compared to conventional pre-clean modules.

During processing in the HPC module 200 a substrate is positioned on the rotatable vacuum table 230 by transferring the substrate 120 through the opening formed in the first side panel 226 by use of the second robot 150 and positioning the substrate 120 on a plurality of lift pins within a lift pin assembly 203. The lift pin assembly 203 includes the plurality of lift pins that can be raised and lowered by use of a lift pin actuator (not shown) so as to allow the substrate 120 to be positioned on and removed from the surface of the rotatable vacuum table 230. A vacuum can then be created between the substrate 120 and openings formed in the surface of the rotatable vacuum table 230 by use of a pump 219. A rotating buffing pad 306 is then brought into contact with a surface of the substrate by use of the head motor 308 and actuator assembly 217. In some embodiments, the rotatable vacuum table 230 and substrate 120 are also rotated by use of a rotational actuator 227 during processing. The rotating buffing pad 306 can then be translated across the surface of the substrate 120 in an oscillating arcuate motion by use of the rotational actuator 213. In some embodiments, the rotational actuator 213 can rotate the buffing pad 306 in an oscillating rotational motion that covers an angle that is less than a full 360 degrees rotation. A first processing fluid, such as DI water and/or one or more first cleaning fluids, can be applied to the surface of the substrate 120 from a fluid source 221 while the rotating buffing pad 306 is translated across the surface of the substrate 120. After processing for a desired period of time, the processing is stopped and the substrate is removed from the HPC module 200 by performing the above mentioned steps in reverse order. However, as will be explained below, the substrate will be beneficially removed from the HPC module 200 through the opening 209 by use of the second robot 150 or a third robot (not shown).

FIG. 3A is a side cross-sectional view of a pad carrier 314 according to one embodiment of the disclosure which may be used in the pad carrier assembly of 304 of FIG. 2A. The pad carrier 314 includes coupling base 310, support plate 315 and buffing pad 306. In some embodiments, the mating of coupling base 310 and the support plate 315 are coupled together via magnetic attraction created by a plurality of magnets 318 disposed within the support plate 315 and a plurality of magnets 316 disposed within the coupling base 310. The plurality of magnets 318 disposed within the support plate 315 and the plurality of magnets 316 disposed with the coupling base 310 are also configured to supply a clamping force between the coupling base 310 and the support plate 315 that is used to compress the lip portion 306A of the buffing pad 306. In some embodiments, the coupling base 310 is a flexible element that is configured to receive the support plate 315. In some embodiments, the magnets 316 in the coupling base 310 are electromagnets that receive power from an external power source (not shown) that is connected to the electromagnets disposed in the coupling base 310 by slip rings that are coupled to the rotating shaft 311 of the head motor 308. In some embodiments, either the magnet 318 or the magnet 316 may be replaced with a ferromagnetic material, or even some paramagnetic materials, that is attracted by an opposing magnet, such as either magnet 316 or magnet 318, respectively. In some embodiments, the magnets 316 and magnets 318 are similarly positioned in an array that is distributed about a central axis of pad carrier 314 (e.g., axis coincident with axis c2, shown in FIG. 2B). In some embodiments, either the array of magnets 316 or the array of magnets 318 are replaced by a toroidal shaped element that is ferromagnetic or paramagnetic and has a central axis that is coincident with the central axis of pad carrier 314. Alternatively, as shown in FIG. 3B, the support plate 315 includes threaded holes 363 in the top surface of the support plate 315. The coupling base 310 and support plate 315 are coupled together by a plurality of fasteners 320 and threaded holes 363 that are also configured to supply a clamping force between the coupling base 310 and the support plate 315 that is used to compress the lip portion 306A of the buffing pad 306. In some embodiments, both magnets and fasteners are used to couple the support plate 315 to the coupling base 310. In one embodiment, the coupling base 310 may be coupled to the shaft 311, as shown in FIG. 2B, by a quick release attachment (not shown) so the pad carrier 314 may be easily removed for buffing pad 306 replacement on pad carrier 314 and then quickly reinstalled on shaft 311.

Figure 3C:
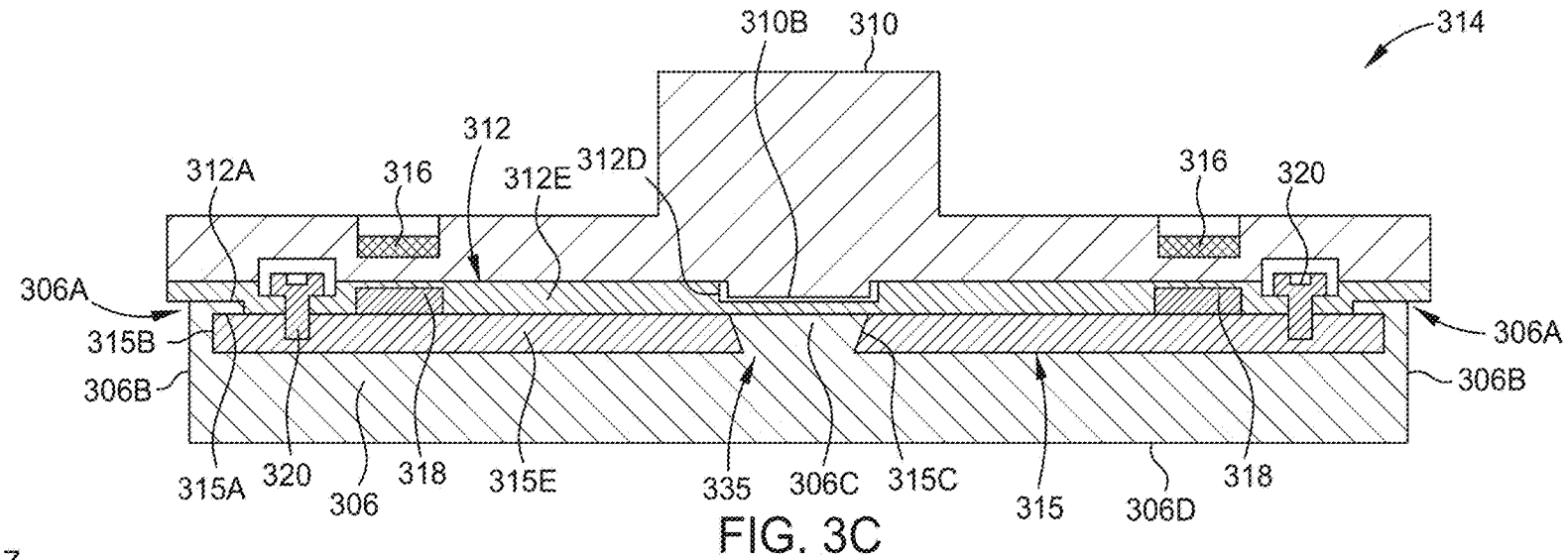
Figure 3D:
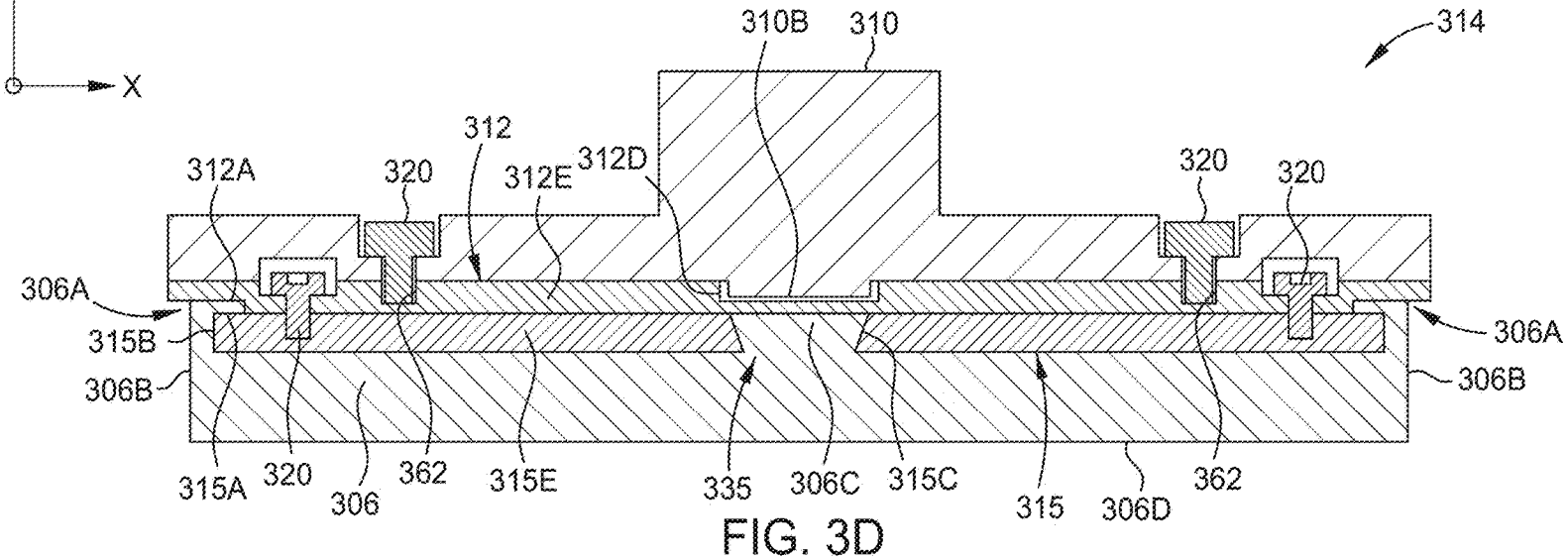
Figure 3E:
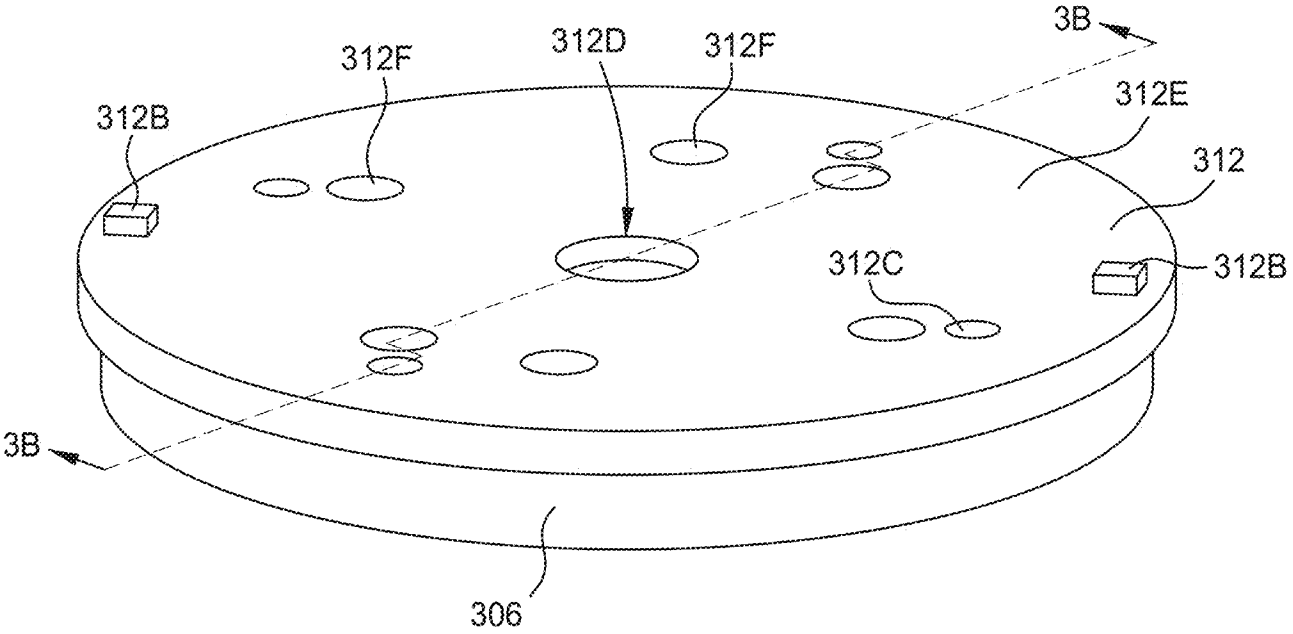
FIG. 3E is a top isometric view of a pad carrier, according to one or more embodiments.

In some embodiments, as shown in FIGS. 3C-3D, the pad carrier 314 includes the coupling base 310 and support plate 315 as described above with regards to FIGS. 3A and 3B, and further includes clamp plate 312, and as combined, are configured to clamp and retain lip portion 306A of a buffing pad 306. FIG. 3E further shows a top isometric view of one embodiment of a clamp plate 312 coupled to buffing pad 306. The clamp plate 312 includes a body 312E that includes an array of enclosed regions 312F that each contain a magnet 318, counter-sunk hole regions 312C, the recess 312D and a surface 312A. Referring to FIGS. 3C, 3D and 3E, the coupling base 310, clamp plate 312 and the support plate 315 can be positioned, coupled and aligned relative to each other by use of locating elements 312B and/or mating elements found in the central region, such as a recess 312D of the clamp plate 312 and mating element 310B of the coupling base 310. In some embodiments, the mating elements found in the central region are formed in a non-cylindrical or non-circular shape in the X-Y-plane, such as a rectangular, oval or even star shape, to allow the mating elements to transfer torque between the coupling base 310 and the clamp plate 312. In some embodiments, as shown in FIG. 3C, the mating of coupling base 310 and the clamp plate 312 are coupled via magnetic attraction created by a plurality of magnets 318 disposed within the clamp plate 312 and a plurality of magnets 316 disposed with the coupling base 310. Alternatively, in one embodiment as shown in FIG. 3D, clamp plate 312 includes a plurality of counter-sunk threaded holes 362, each threaded hole 362 configured to accept a fastener 320. The mating of coupling base 310 and the clamp plate 312 are coupled via a plurality of fasteners 320 and threaded holes 362. In some embodiments, both magnets and fasteners are used to couple the clamp plate 312 to the coupling base 310.

Figure 3F:
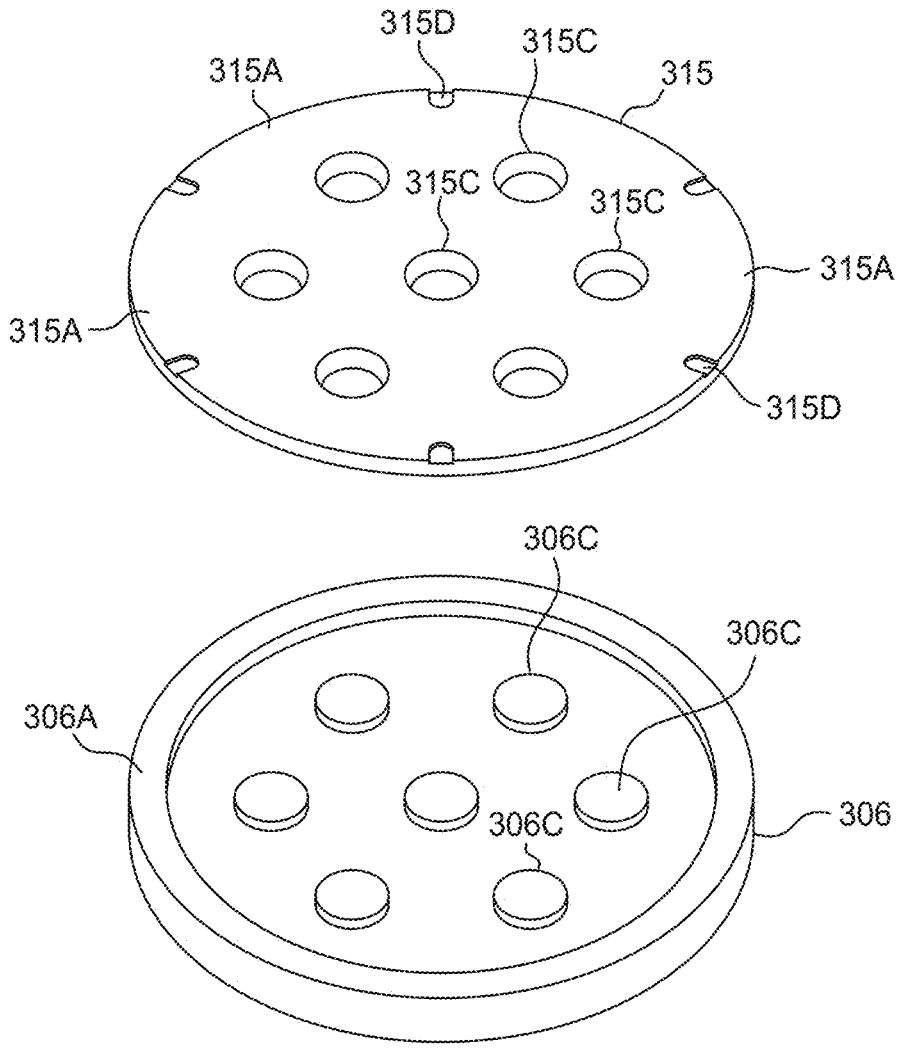
FIG. 3F is a top side exploded view of components within a pad carrier according to one or more embodiments.

FIG. 3F shows an exploded view of one embodiment of the support plate 315 and buffing pad 306. The support plate 315 includes a plurality of support plate retaining features 315C, a surface 315A, and may optionally contain a plurality of threaded features that are configured to receive a portion of a fastener 320. In some embodiments, the support plate 315 further includes a plurality of enclosed regions (not shown) that each contain a magnet 318, as similarly discussed above. In some embodiments, the support plate 315 further includes one or more interlocking features, as shown as depressions 315D at the peripheral edge in the support plate 315. The depressions 315D are provided to further improve the retention of the lip portion 306A of the buffing pad 306 between the support plate 315 and the coupling base 310, or in some embodiments, between the support plate 315 and the clamp plate 312. In some embodiments, the buffing pad 306 is over-molded onto the support plate 315 so that they become an inseparable assembly.

In some embodiments, the buffing pad 306 is formed of polyvinyl alcohol (PVA) material. PVA material is hydrophilic, and can absorb and retain water. When wet, PVA material is elastic, flexible, and soft, having mechanical strength and abrasion resistance. Compared to conventional material used as a buffing pad, such as poromeric material or filled or unfilled polymer material, PVA material provides high shear force for chemical and mechanical cleaning. The buffing pad 306 formed of PVA material has a diameter of greater than 70 mm, which is larger than a diameter of a typical buffing pad formed of conventional material, having a diameter about 67 mm. A larger buffing pad improves performance and reduces buffing time in chemical mechanical cleaning. Furthermore, a buffing pad 306 formed of PVA material is thicker than a typical buffing pad formed of conventional material. The pad carrier 314 is designed to support a large and thick water absorbent buffing pad 306 while preventing the buffing pad 306 from sagging by a mechanical clamping and support mechanism.

In one embodiment, referring to FIG. 3A, when positioned against the coupling base 310 and ready to perform a buffing process, the lip portion 306A of the buffing pad 306 is compressed between two surfaces 310A and 315A of the coupling base 310 and the support plate 315, respectively. The magnetic attraction created between magnets 318 of the support plate 315 and magnets 316 of the coupling base 310 is used to create a force that compresses the lip portion 306A of the buffing pad 306 between the surface 315A of the support plate 315 and a surface 310A of the coupling base 310. In one embodiment, the two surfaces 310A and 315A are substantially parallel to each other. In some embodiments, the surface 315A and/or opposing surface of the lip portion 306A include one or more interlocking features, as shown as depressions 315D in the support plate 315 in FIG. 3F. The interlocking features are provided to further improve the retention of the lip portion 306A of the buffing pad 306 between the surface 310A and 315A. In some embodiments, the clamping area of the surfaces 310A and 315A, between which the lip portion 306A is disposed during processing, are oriented such that they are perpendicular to the direction that the magnets 318 and 316 are aligned (i.e., Z-direction), and/or parallel to the polishing surface 306D of the buffing pad 306 (e.g., X-Y-plane). In some embodiments, as shown in FIGS. 3B, 3C and 3D, a plurality of fasteners 320 are configured to supply a clamping force that is used to compress the lip portion 306A of the buffing pad 306. In some embodiments, the fasteners 320 can include one or more locating pins. In either configuration, magnets 316 and 318 or fasteners 320, the material within the lip portion 306A can be compressed between about 5% and 95% of its uncompressed state, such as between about 20% and about 80%, or between about 40% and about 60% of the original thickness of the material (e.g., PVA) of the lip portion 306A of the buffing pad 306.

Referring to FIGS. 3A-3D and 3F, in some embodiments, the pad carrier 314 includes a plurality of retaining features 335 in which a pad retaining feature 306C of the buffing pad 306 is engaged with a support plate retaining feature 315C of the support plate 315. The retaining features 335 form a portion of the mechanical clamping mechanism and are used to position and retain the position of the buffing pad 306 relative to the support plate 315 during processing, and thus after the buffing pad 306 has become soaked with the processing chemistry and/or also while various shear and compression loads are being applied during processing. The retaining features 335 are also used to prevent sagging of portions of the buffing pad 306 relative to the support plate 315. Sagging of the buffing pad 306 can undesirably cause the sagging portions of the buffing pad 306 to contact the surface of the substrate as the substrate is moved relative to the pad carrier 314 before or after the a buffing process has been performed on a substrate.

Referring to FIG. 3F, in some embodiments, the buffing pad 306 and support plate 315 each include pad retaining features 306C and support plate retaining features 315C, respectively, that are formed in a desired mating pattern so as minimize or prevent sagging of the buffing pad 306 and to mechanically clamp the pad 306 to the support plate to reliably handle the loads applied to the buffing pad 306 during processing. In some embodiments, the retaining features 335 can be formed so that pad retaining features 306C and support plate retaining features 315C form an overlapping and/or interference fit that is able to substantially fix the position of the buffing pad 306 relative to the support plate 315. As illustrated in FIGS. 3A-3D, the pad retaining features 306C can be formed in an inverted cone shape and the support plate retaining features 315C can be formed in countersunk hole configuration so that the top most portion of the pad retaining features 306C overlaps with the lower portion of the support plate retaining features 315C. In some embodiments, pad retaining features 306C and support plate retaining features 315C of each retaining feature 335 of the plurality of retaining features is formed in a round, oval, spiral, or in a slot shaped configuration. In some configurations, the array or pattern of retaining features 335 includes two or more different retaining feature shapes.

Figure 4A:
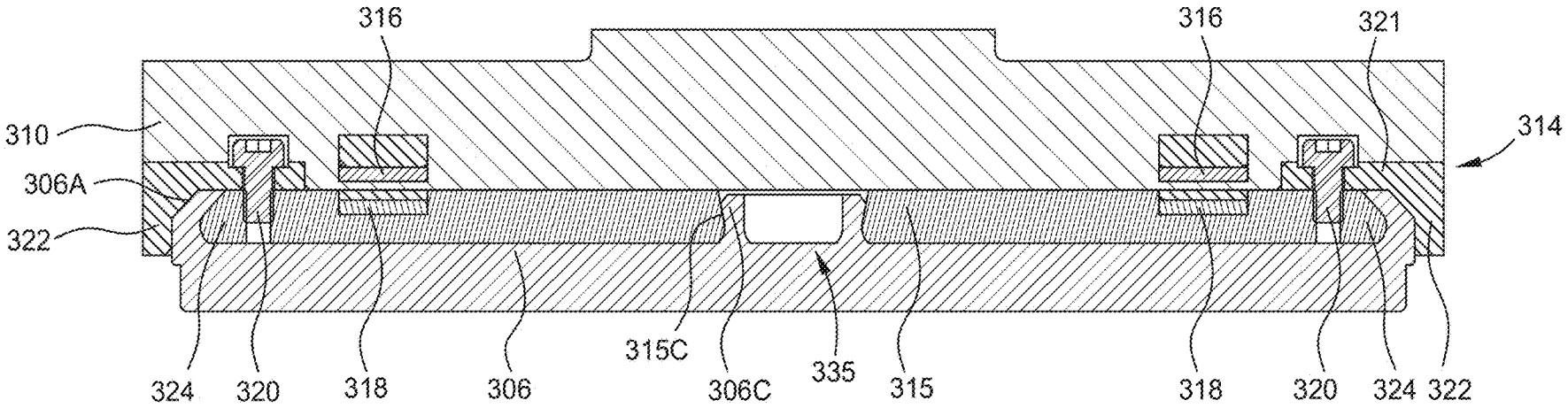
FIG. 4A is a side sectional view of an exemplary a coupling base and a pad carrier according to one or more embodiments.

FIG. 4A is a side sectional view of an exemplary pad carrier 314 including a coupling base 310 and a support plate 315 which may be used in the pad carrier assembly 304 of FIG. 2B. In some embodiments, the coupling base 310 includes magnets 316 and the support plate 315 includes magnets 318 such that the coupling base 310 and the pad carrier 314 are coupled via magnetic force. In some embodiments, the magnets 316 and magnets 318 are similarly positioned in an array that is distributed about a central axis of pad carrier 314 (e.g., axis coincident with axis c2 shown in FIG. 2B). In one embodiment, the magnets 316 and magnets 318 include a ferromagnetic or paramagnetic material. In some embodiments, either the array of magnets 316 or the array of magnets 318 are replaced by a toroidal shaped element that is ferromagnetic or paramagnetic and has a central axis that is coincident with the central axis of pad carrier 314. The coupling base 310 and the support plate 315 are aligned via fasteners 320. In some embodiments, the fasteners 320 can include screws and bolts. In an alternative embodiment, the coupling base 310 and the support plate 315 are aligned via alignment pins or locating pins.

The pad carrier 314 may further include a lip ring 321 having a lip ring peripheral portion 322 on a peripheral edge of the lip ring 321. The support plate 315 includes a tapered portion 324 on a peripheral edge of the support plate 315, tapering from a bottom surface towards a top surface of the support plate 315 facing the coupling base 310, such that the tapered portion 324 is substantially parallel to an inner surface of the lip ring peripheral portion 322 of the lip ring 321. The lip ring peripheral portion 322 of the lip ring 321 and the tapered portion 324 of the support plate 315 together mechanically clamp the buffing pad 306 along a peripheral edge of the buffing pad lip portion 306A. Support plate 315 has a diameter of between about 70 mm and 150 mm, such as about 128 mm on the bottom surface, and thickness of between about 2 mm and 10 mm, or between about 3 mm and 7 mm, such as about 4.2 mm. In some embodiments, the diameter of the support plate 315 on the top surface is smaller than the diameter of the support plate 315 by between about 1 mm and about 5 mm.

Figure 4B:
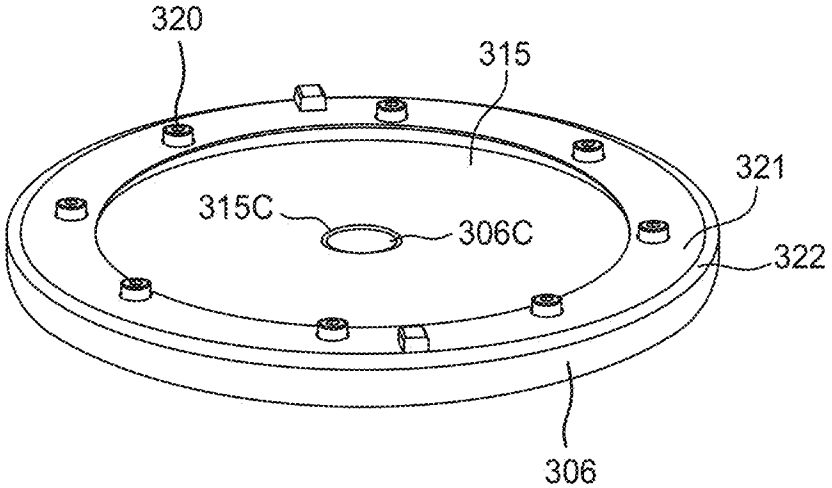
FIGS. 4B and 4C are a plan view and a side sectional view of a pad carrier according to one or more embodiments.
Figure 4C:
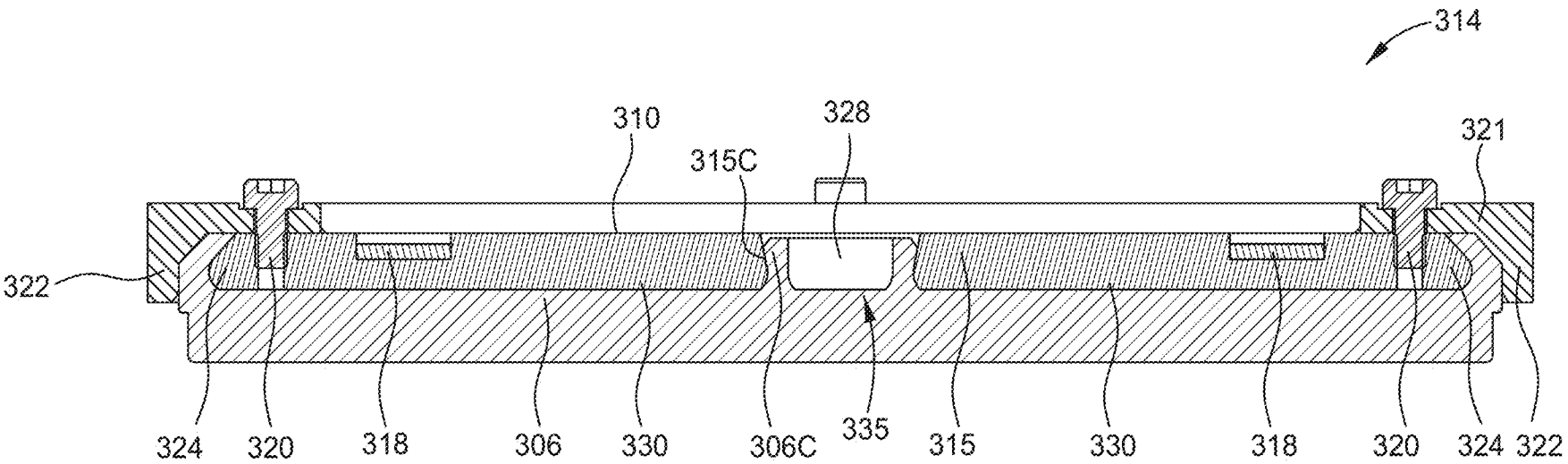

FIGS. 4B and 4C are a plan view and a side sectional view of the pad carrier 314 according to one embodiment. In FIG. 4C, a portion of the lip ring 321, support plate 315 and the buffing pad 306 are also shown. In some embodiments, the pad carrier 314 includes a plurality of retaining features 335 in which a pad retaining feature 306C of the buffing pad 306 is engaged with a support plate retaining feature 315C of the support plate 315. The support plate 315 includes a support plate retaining feature 315C through which a pad retaining feature 306C is pushed into the support plate retaining feature 315C. The support plate retaining feature 315C is a circular shaped through hole with a diameter of between about 10 mm and about 25 mm, such as about 15 mm, and negatively tapered from a surface facing the coupling base 310 towards a surface facing the buffing pad 306 (i.e., a diameter at the surface facing the coupling base 310 is larger than a diameter at the surface facing the buffing pad 306). The pad retaining feature 306C is cylindrically shaped with a diameter slightly larger than the diameter of the support plate retaining feature 315C such that the pad retaining feature 306C is compressed when inserted into the support plate retaining feature 315C. The coupling base 310, lip ring 321 and the support plate 315 may be formed of a plastic or polymer, such as polyether ether ketone (PEEK). The buffing pad 306 can be securely supported using the mechanical clamping mechanism which includes the lip peripheral portion 322 of lip ring 321, the tapered portion 324 at the peripheral edge of the support plate 315, and the support plate retaining feature 315C and the pad retaining feature 306C. In FIGS. 4B and 4C, one circular support plate retaining feature 315C and one cylindrical pad retaining feature 306C are illustrated. However, as shown in FIG. 3F, the support plate 315 may have multiple support plate retaining features 315C, each of which receives one pad retaining feature 306C, to create a retention force that holds the buffing pad 306 in a position relative to the pad carrier 314. The pad retaining feature 306C may be of any raised shape and the support plate retaining feature 315C has a shape that matches the shape of the pad retaining feature 306C such that the pad retaining feature 306C and the support plate retaining feature 315C form an overlapping and/or interference fit that is used to retain the buffing pad 306.

Figure 4D:
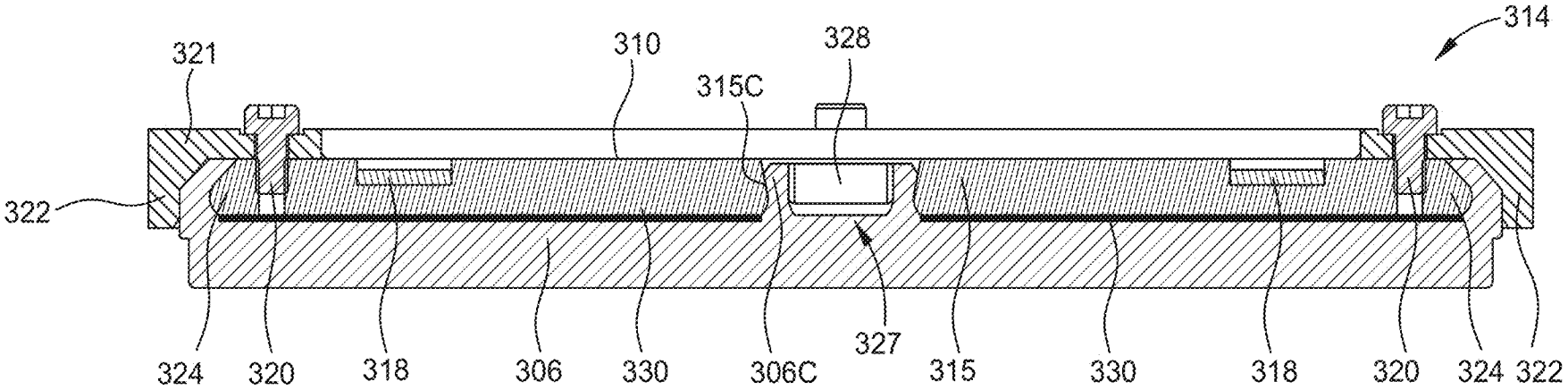
FIG. 4D is a side sectional view of a pad carrier according to one or more embodiments.

FIG. 4D is a side sectional view of the pad carrier 314 according to another embodiment. The pad carrier 314 includes a central support plate retaining feature 315C through which a pad retaining feature 306C is pushed into the support plate retaining feature 315C, as in the embodiment shown in FIG. 4C. In this embodiment, a backing 330 that is in contact with the buffing pad 306 is disposed on a surface of the buffing pad 306. The backing 330 may be disposed on the surface of the buffing pad 306 that faces the support plate 315. The backing 330 may be formed of plastic and adds stiffness to the buffing pad 306, further preventing the buffing pad 306 from sagging. In some embodiments, the raised pad retaining feature 306C may include a cavity or hole 327 in the top surface of the pad retaining feature 306C, and a puck 328 matching the shape of the hole 327 may be inserted within the hole 327. The pad hole may be of any shape, preferably a shape matching the shape of the pad retaining feature 306C, and the puck 328 has a shape that matches the shape of the hole 327 but slightly wider in diameter such that the hole 327 in the pad retaining feature 306C and puck 328 form an overlapping and/or interference fit that is used to further create an enhanced pressure fit between the pad retaining feature 306C and the support plate retaining feature 315C. In this embodiment the puck 328 may be formed of a plastic or polymer, such as polyether ether ketone (PEEK) or other solid chemical resistant material such as ceramic, aluminum or stainless steel.

Figure 4F:
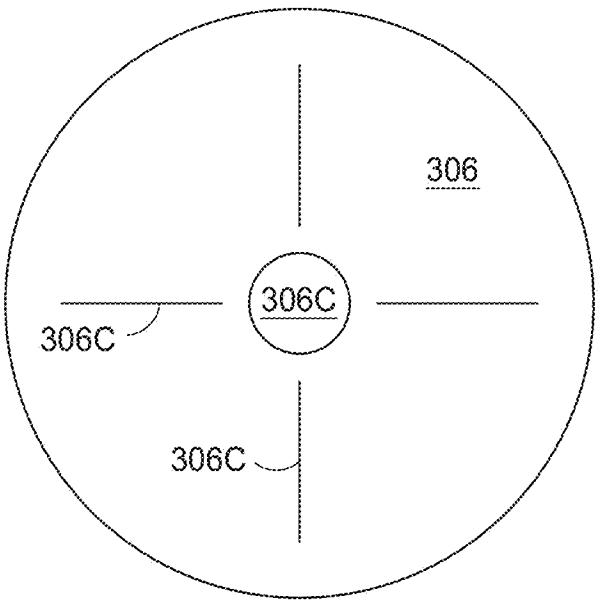
FIGS. 4E and 4F are top views of a buffing pad according to one or more embodiments.
Figure 4E:
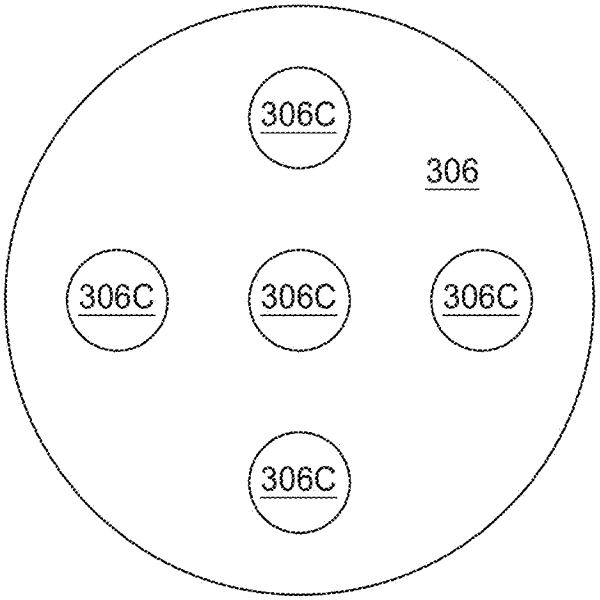

FIGS. 4E and 4F are top views of the buffing pad 306 according to other embodiments. In these embodiments, the buffing pad 306 has raised pad retaining features 306C formed on a surface of the buffing pad 306 facing the support plate 315, and the support plate 315 has multiple support plate retaining features 315C, in each of which one of the pad retaining features 306C engages. The pad retaining features 306C of the buffing pad 306 are arranged to be inserted into the support plate retaining features 315C of the support plate 315 in overlapping contact with each other creating a retaining force to hold the buffing pad 306 against the pad carrier 314. In FIG. 4E, multiple raised pad retaining features 306C are in the shape of pillars and each of the pad retaining features 306C engages in a matching support plate retaining feature 315C of the support plate 315. In FIG. 4F, the pad retaining features 306C include a central pad retaining feature 306C in the shape of a pillar that engages in a circular support plate retaining features 315C that matches the shape of the pillar and pad retaining features 306C also includes radial spokes each of which engages support plate retaining features 315C in the shape of a rectangular slot that matches the shape of the radial spokes.

In the embodiments described herein, pad carriers that support a large and thick water absorbent buffing pad, such as a buffing pad formed of polyvinyl alcohol (PVA) material, while preventing the buffing pad from sagging by a mechanical clamping mechanism in chemical mechanical cleaning. A buffing pad formed of polyvinyl alcohol (PVA) material provides high shear force for chemical and mechanical polishing due to mechanical strength and abrasion resistance. A large sized buffing pad provides improved cleaning performance.

Embodiments of the present disclosure may also provide a horizontal pre-clean module. The horizontal pre-clean module includes a chamber including a basin and a lid which collectively define a processing area, a rotatable vacuum table disposed in the processing area, the rotatable vacuum table including a substrate receiving surface, a pad conditioning station disposed proximate to the rotatable vacuum table, a pad carrier positioning arm having a first end and a second end distal from the first end, a pad carrier assembly coupled to the first end of the pad carrier positioning arm, and an actuator coupled to the second end of the pad carrier positioning arm and configured to swing the pad carrier assembly between a first position over the rotatable vacuum table and a second position over the pad conditioning station. The pad carrier assembly includes a coupling base and a pad carrier coupled to the coupling base, the coupling base and the pad carrier are configured to support a buffing pad by a mechanical clamping mechanism.

While the foregoing is directed to embodiments of the present disclosure, other and further embodiments of the disclosure may be devised without departing from the basic scope thereof, and the scope thereof is determined by the claims that follow.

The invention claimed is:

1. A pad carrier for use in a polishing or cleaning process, comprising:

a pad carrier assembly that is configured to be coupled to a first end of a pad carrier positioning arm, wherein the pad carrier assembly comprises:

a clamp plate that comprises a clamp body that comprises:

one or more ferromagnetic or paramagnetic material containing elements disposed within the clamp body; and a first retaining surface disposed on a first side of the clamp body; and a support plate that comprises a support body that comprises:

a second retaining surface disposed on a first side of the support body; and a plurality of support plate retaining features, wherein each support plate retaining feature is configured to receive a pad retaining feature formed in a buffing pad when a lip portion of the buffing pad is positioned between and in contact with the first and second retaining surfaces.

2. The pad carrier of claim 1, further comprising a coupling base that comprises a coupling plate body that comprises one or more ferromagnetic or paramagnetic material containing elements disposed within the coupling plate body, wherein each of the one or more ferromagnetic or paramagnetic material containing elements within the coupling plate body of the coupling base is configured to oppose each of a corresponding one of the one or more ferromagnetic or paramagnetic material containing elements within the support body of the support plate when the coupling base is positioned over a second side of the support body of the support plate, and the second side of the support body of the support plate is opposite to the first side.

3. The pad carrier of claim 2, wherein the one or more ferromagnetic or paramagnetic material containing elements in the coupling base or the clamp plate comprise a ferromagnetic or paramagnetic containing element that is formed in a toroidal shape.

4. The pad carrier of claim 1, wherein the one or more ferromagnetic or paramagnetic material containing elements comprise an array of ferromagnetic containing elements that are magnetic.

5. The pad carrier of claim 1, wherein the one or more ferromagnetic or paramagnetic material containing elements comprise a ferromagnetic or paramagnetic containing element that is formed in a toroidal shape.

6. The pad carrier of claim 5, wherein the ferromagnetic or paramagnetic containing element formed in a toroidal shape has a central axis that is coincident with a central axis of the pad carrier.

7. The pad carrier of claim 1, wherein the one or more ferromagnetic or paramagnetic material comprises a ferromagnetic material.

8. The pad carrier of claim 1, wherein the support plate further includes one or more interlocking features at a peripheral edge of the second retaining surface.

9. The pad carrier of claim 1, wherein the pad retaining features is formed in an inverted cone shape and the support plate retaining feature is formed in a countersunk hole configuration so that a top most portion of the pad retaining feature overlaps with the lower portion of the support plate retaining feature.

10. A pad carrier for use in cleaning process, comprising:
a pad carrier assembly that is configured to be coupled to
a first end of a pad carrier positioning arm, wherein the pad carrier assembly comprises:
a coupling base that comprises a coupling body that comprises:
an array of magnets disposed within the coupling body; and
a first retaining surface disposed on a first side of the coupling body;
a support plate that comprises a support body that comprises:
an array of magnets disposed within the support body; and
a second retaining surface disposed on a first side of the support body; and
a plurality of support plate retaining features,
wherein each support plate retaining feature is configured to receive a pad retaining feature formed in a buffing pad when a lip portion of the buffing pad is positioned between and in contact with the first and second retaining surfaces.

11. The pad carrier of claim 10, wherein
each magnet within the array of magnets within the coupling body of the coupling base is configured to oppose each of a corresponding magnet within the array of magnets within the support body of the support plate when the coupling base is positioned over a second side of the support body of the support plate, and
the second side of the support body of the support plate is opposite to the first side.

12. The pad carrier of claim 10, wherein the array of magnets disposed within the coupling body of the coupling base or the magnets within the support body of the support plate comprise a ferromagnetic or paramagnetic containing element.

13. The pad carrier of claim 10, wherein the array of magnets within the coupling body of the coupling base and the array of magnets within the support body of the support plate are formed in a toroidal shape.

14. The pad carrier of claim 13, wherein the array of magnets formed in a toroidal shape has a central axis that is coincident with a central axis of the pad carrier.

15. The pad carrier of claim 10, wherein the pad retaining features are formed in an inverted cone shape and the support plate retaining features are formed in a countersunk hole configuration so that a top most portion of each of the pad retaining features overlap with the lower portion of each of the support plate retaining features.

16. A pad carrier for use in a polishing or cleaning process, comprising:
a pad carrier assembly that is configured to be coupled to
a first end of a pad carrier positioning arm, wherein the pad carrier assembly comprises:
a coupling base that comprises a coupling body that comprises:
a first retaining surface disposed on a first side of the coupling body; and
a support plate that comprises a support body that comprises:
a second retaining surface disposed on a first side of the support body; and
a plurality of support plate retaining features,
wherein each support plate retaining feature is configured to receive a pad retaining feature formed in a buffing pad when a lip portion of the buffing pad is positioned between and in contact with the first and second retaining surfaces.

17. The pad carrier of claim 16, further comprising a plurality of holes that are disposed in the support body, and each of the holes comprise a threaded hole configured to accept a fastener.

18. The pad carrier of claim 16, wherein the support body of the support plate is coupled to the coupling body of the coupling base using magnets and fasteners.

19. The pad carrier of claim 16, wherein
the coupling body of the coupling base comprises an array of magnets and the support body of the support plate comprises an array of magnets, each magnet within the array of magnets within the coupling body is configured to oppose each of a corresponding magnet within the array of magnets within the support body when the coupling base is positioned over a second side of the support body, and
the second side of the support body of the support plate is opposite to the first side.

20. The pad carrier of claim 16, wherein the pad retaining features are formed in an inverted cone shape and the support plate retaining features are formed in a countersunk hole configuration so that a top most portion of each of the pad retaining features overlap with the lower portion of each of the support plate retaining features.

* * * * *